US009164426B2

(12) United States Patent
Yoshii et al.

(10) Patent No.: US 9,164,426 B2
(45) Date of Patent: Oct. 20, 2015

(54) TONER CONTAINER, AND IMAGE FORMING APPARATUS INCLUDING THE SAME

(71) Applicant: KYOCERA Document Solutions Inc., Osaka-shi, Osaka (JP)

(72) Inventors: Tatsuhiko Yoshii, Osaka (JP); Koji Murata, Osaka (JP)

(73) Assignee: KYOCERA Document Solutions Inc., Osaka-Shi (JP)

( * ) Notice: Subject to any disclaimer, the term of this patent is extended or adjusted under 35 U.S.C. 154(b) by 0 days.

(21) Appl. No.: 14/231,535

(22) Filed: Mar. 31, 2014

(65) Prior Publication Data

US 2015/0093154 A1 Apr. 2, 2015

(30) Foreign Application Priority Data

Sep. 27, 2013 (JP) ..... 2013-200935

(51) Int. Cl.
*G03G 15/08* (2006.01)

(52) U.S. Cl.
CPC ..... *G03G 15/0875* (2013.01); *G03G 15/0812* (2013.01)

(58) Field of Classification Search
CPC ..... G03G 2215/085; G03G 15/0834; G03G 15/0837; G03G 15/0875; G03G 15/0812
USPC ..... 399/263
See application file for complete search history.

(56) References Cited

U.S. PATENT DOCUMENTS

2008/0095553 A1* 4/2008 Tanaka et al. ..... 399/263
2012/0201575 A1 8/2012 Kashimoto et al.

FOREIGN PATENT DOCUMENTS

EP 2485093 A1 8/2012
JP 2003202737 A 7/2003
JP 2004361463 A 12/2004
JP 2012220622 A 11/2012

OTHER PUBLICATIONS

European Patent Office, Extended European Search Report Issued in European Patent Application No. 14161488.3, Jan. 26, 2015, Germany, 6 pages.

* cited by examiner

*Primary Examiner* — David Bolduc
*Assistant Examiner* — Barnabas Fekete
(74) *Attorney, Agent, or Firm* — Alleman Hall McCoy Russell & Tuttle LLP

(57) ABSTRACT

A toner container according to one aspect of the present disclosure includes a container body, a rotating member, a conveying member, a film member, and a stepped portion. Container body can store toner thereinside. Container body includes toner conveying path having supply opening through which toner is supplied to the outside. Rotating member is rotatably provided in container body. Rotating member rotates to scoop, into toner conveying path, toner stored in container body. Conveying member is rotatably provided in toner conveying path. Conveying member rotates to convey, toward the supply opening, toner in toner conveying path. Film member is mounted to an inner wall which extends from toner conveying path to an inner side of container body, and projects toward a region in which rotating member rotates. Stepped portion is provided in the inner wall. Stepped portion forms, between stepped portion and film member, a space having a predetermined height.

15 Claims, 10 Drawing Sheets

TONER CONTAINER, AND IMAGE FORMING APPARATUS INCLUDING THE SAME

INCORPORATION BY REFERENCE

This application is based upon and claims the benefit of priority from the corresponding Japanese Patent Application No. 2013-200935 filed on Sep. 27, 2013, the entire contents of which are incorporated herein by reference.

BACKGROUND

The present disclosure relates to toner containers that have rotating members thereinside, and image forming apparatuses that have the toner containers.

Developing devices are mounted to image forming apparatuses, such as copy machines and printers, which form images on print sheets by electrophotography. In the developing device, developer including toner is stored. The developing device develops an electrostatic latent image formed on an image carrier such as a photosensitive drum by using the toner included in the developer. Toner in the developing device is reduced by the development being performed. Therefore, the image forming apparatus is structured so as to include a toner container in which toner is stored, and additionally supply toner from the toner container to the developing device. Further, the toner container is detachably mounted to the image forming apparatus. When the toner in the toner container is all consumed, the toner container is exchanged for a new toner container that is filled with toner.

In the toner container, a storage chamber in which toner is stored, and a toner conveying path having a supply opening formed therein, are provided. Further, in the storage chamber, a rotating member that agitates toner and scoops toner into the toner conveying path is provided. Further, in the toner conveying path, a conveying member that conveys toner to the supply opening is provided. The rotating member is rotated to scoop toner into the toner conveying path, and the toner is then conveyed to the supply opening by the conveying member. Thus, toner is supplied to the developing device through the supply opening.

In this type of toner container, toner may be adhered to and accumulated on an inner wall that extends from the toner conveying path to the storage chamber. To date, a toner supply container having a guide film which can contact with the rotating member that can be rotated, in order to shake toner accumulated on the inner wall and return the toner into the storage chamber, has been known. The guide film is mounted to the inner wall. Therefore, the guide film oscillates by contacting with the rotating member, and toner accumulated on the inner wall is returned into the storage chamber so as to be shaken due to the oscillation. The guide film is disposed parallel to the inner wall that extends from the toner conveying path to the storage chamber. Therefore, the oscillation of the guide film may not be easily transmitted to the inner wall. Further, the guide film may prevent movement of toner scooped by the rotating member, and toner may not be sufficiently conveyed to the toner conveying path.

SUMMARY

A toner container according to one aspect of the present disclosure includes a container body, a rotating member, a conveying member, a film member, and a stepped portion. The container body can store toner thereinside. The container body includes a toner conveying path having a supply opening through which toner is supplied to the outside. The rotating member is rotatably provided in the container body. The rotating member rotates to scoop, into the toner conveying path, toner stored in the container body. The conveying member is rotatably provided in the toner conveying path. The conveying member rotates to convey, toward the supply opening, toner in the toner conveying path. The film member is mounted to an inner wall which extends from the toner conveying path to an inner side of the container body, and projects toward a region in which the rotating member rotates. The stepped portion is provided in the inner wall. The stepped portion forms, between the stepped portion and the film member, a space having a predetermined height.

An image forming apparatus according to another aspect of the present disclosure includes a toner container and an image forming portion. The toner container includes a container body, a rotating member, a conveying member, a film member, and a stepped portion. The container body can store toner thereinside. The container body includes a toner conveying path having a supply opening through which toner is supplied to the outside. The rotating member is rotatably provided in the container body. The rotating member rotates to scoop, into the toner conveying path, toner stored in the container body. The conveying member is rotatably provided in the toner conveying path. The conveying member rotates to convey, toward the supply opening, toner in the toner conveying path. The film member is mounted to an inner wall which extends from the toner conveying path to an inner side of the container body, and projects toward a region in which the rotating member rotates. The stepped portion is provided in the inner wall. The stepped portion forms, between the stepped portion and the film member, a space having a predetermined height. The image forming portion forms an image on a recording medium by using toner supplied from the toner container.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
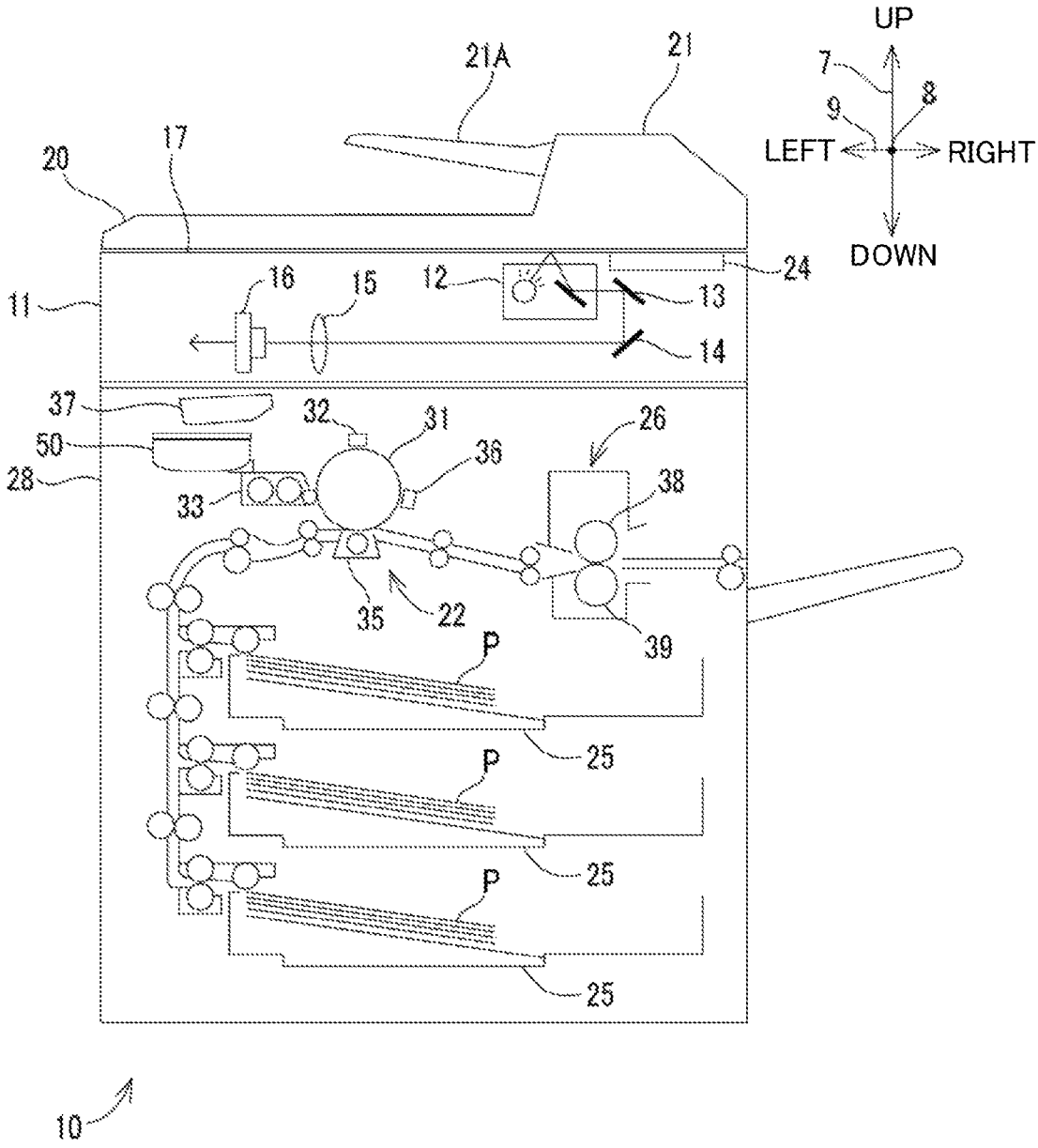
FIG. 1 illustrates a structure of an image forming apparatus according to an embodiment of the present disclosure.

Hereinafter, a toner container 50 and an image forming apparatus 10 according to an embodiment of the present disclosure will be described with reference to the drawings. In the below description, an up-down direction 7 is defined based on a state (a state shown in FIG. 1) where the image forming apparatus 10 is installed on a flat plane. Further, a front-rear direction 8 is defined based on the near side (front surface side) representing a side on which the toner container 50 is inserted into the image forming apparatus 10 shown in FIG. 1. Further, a right-left direction 9 is defined by the image forming apparatus 10 shown in FIG. 1 being viewed from the near side (the front surface side).

[Schematic Structure of Image Forming Apparatus 10]

The image forming apparatus 10 is an apparatus that has at least a printing function, and is implemented as, for example, a multifunction peripheral. The image forming apparatus 10 prints an image on a print sheet P (recording medium) that is a sheet-like medium, by using developer including toner. The image forming apparatus 10 is not limited to a multifunction peripheral, and may be a single function machine such as a printer, a FAX apparatus, or a copy machine.

As shown in FIG. 1, the image forming apparatus 10 mainly includes an image reading portion 11, a document sheet cover 20, an ADF (Automatic Document Feeder) 21, an image forming portion 22, an operation display portion 24, a sheet feed device 25, a fixing device 26, the toner container 50, and a control portion (not shown) that comprehensively controls the image forming apparatus 10. These components are mounted to a casing 28 that forms an external frame (not shown), an internal frame (not shown), and the like of the image forming apparatus 10.

The image reading portion 11 executes an image reading process in which image data is read from a document sheet placed on a contact glass 17. As shown in FIG. 1, the image reading portion 11 includes a reading unit 12, mirrors 13 and 14, an optical lens 15, a CCD 16, and the like. The reading unit 12 includes, for example, a light source such as a LED, and can be moved in a secondary scanning direction (the right-left direction 9 in FIG. 1) by a not-illustrated moving mechanism using a motor such as a stepping motor. When the reading unit 12 is moved in the secondary scanning direction by the motor, scanning in the secondary scanning direction is performed with light applied from the light source toward the contact glass 17 of the image reading portion 11. The light is reflected by a document sheet toward the mirror 13 due to this scanning, and is further guided to the optical lens 15 by the mirror 14. The optical lens 15 focuses the incident light on the CCD 16. The CCD 16 outputs, to the control portion, data representing an amount of light that corresponds to an amount of received light. When the control portion obtains data representing an amount of light for the entire region to which the light is applied, the control portion processes the data representing the amount of light, thereby generating image data of the document sheet based on the data representing the amount of light. In the present embodiment, an exemplary case where the CCD 16 is used as an imaging device is described. However, instead of the reading mechanism using the CCD 16, a reading mechanism that includes a contact image sensor (CIS) having a focal length shorter than the CCD 16 may be used.

The ADF 21 is mounted in the document sheet cover 20. The ADF 21 sequentially conveys document sheets that are set in a document sheet setting portion 21A, by a plurality of conveying rollers (not shown), and moves the document sheets, through a reading position defined on the contact glass 17, rightward in the secondary scanning direction. When the document sheets are moved by the ADF 21, the reading unit 12 is positioned at a position below the reading position, and an image of the document sheet being moved is read at this position by the reading unit 12.

The image forming portion 22 executes an image forming process in which an image is formed on a print sheet P according to a so-called electrophotography. The image forming portion 22 prints an image on the print sheet P based on image data read by the image reading portion 11, or image data inputted from the outside through a not-illustrated network communication portion. For example, when a printing job is transferred from a personal computer, the image forming portion 22 prints an image on the print sheet P based on image data and printing condition indicated by the printing job. As shown in FIG. 1, the image forming portion 22 includes a photosensitive drum 31, a charging device 32, a developing device 33, a transfer device 35, an electricity removing device 36, an exposure device (LSU: Laser Scanner Unit) 37, and the like.

When the image forming process by the image forming portion 22 is started, the surface of the photosensitive drum 31 is charged to have a uniform potential by the charging device 32. Scanning is performed on the photosensitive drum 31 by the exposure device 37, with laser light corresponding to the image data. Thus, an electrostatic latent image is formed on the photosensitive drum 31. Thereafter, toner is adhered to the electrostatic latent image by developing process of the developing device 33, to form a toner image on the photosensitive drum 31. The toner image is transferred, by the transfer device 35, to a print sheet P conveyed in a conveying path. The print sheet P having the toner image transferred thereto is conveyed to the fixing device 26 disposed downstream (the right side in FIG. 1) of the image forming portion 22 in a direction in which the print sheet P is conveyed.

The fixing device 26 fixes, by heat, the toner image transferred to the print sheet P, onto the same print sheet P. The fixing device 26 includes a heating roller 38 and a pressure roller 39. The pressure roller 39 is urged toward the heating roller 38, by an elastic member such as a spring. Thus, the pressure roller 39 is pressed against the heating roller 38. The heating roller 38 is heated to a high temperature by a heater when the fixing operation is performed. When the print sheet P passes through the fixing device 26, toner of the toner image is heated by the heating roller 38 and fused, and the print sheet P is pressed by the pressure roller 39. Thus, toner is fixed onto the print sheet P by the fixing device 26, and an image is formed on the print sheet P.

[Structure of Toner Container 50]

Hereinafter, a structure of the toner container 50 will be described in detail with reference to FIG. 2 to FIG. 9. In each of FIG. 2 to FIG. 9, based on an orientation (mounted orientation) of the toner container 50 mounted to the casing 28, the vertical direction is defined as the up-down direction 7, a direction in which the toner container 50 is inserted into and detached from the casing 28 is defined as the front-rear direction 8, and the horizontal direction as viewed from the front of the casing 28 is defined as the right-left direction 9.

The toner container 50 operates to supply toner to the developing device 33. As shown in FIG. 1, the toner container 50 is mounted on the upper left side portion of the casing 28. More specifically, the toner container 50 is disposed above and to the left of the developing device 33, and below the exposure device 37. The toner container 50 is detachably mounted to a container mounting portion (not shown) of the casing 28. The toner container 50 is supported so as to be slidable in the front-rear direction 8 such that the toner container 50 can be inserted into or detached from the container mounting portion in the front-rear direction 8. As a slide support mechanism for the toner container 50, for example, a rail support mechanism that includes rail grooves, and rail guides which are guided by the rail grooves, can be used. Needless to say, any mechanism, other than the rail support mechanism, which supports the toner container 50 so as to be slidable in the front-rear direction 8 may be used.

Figure 2:
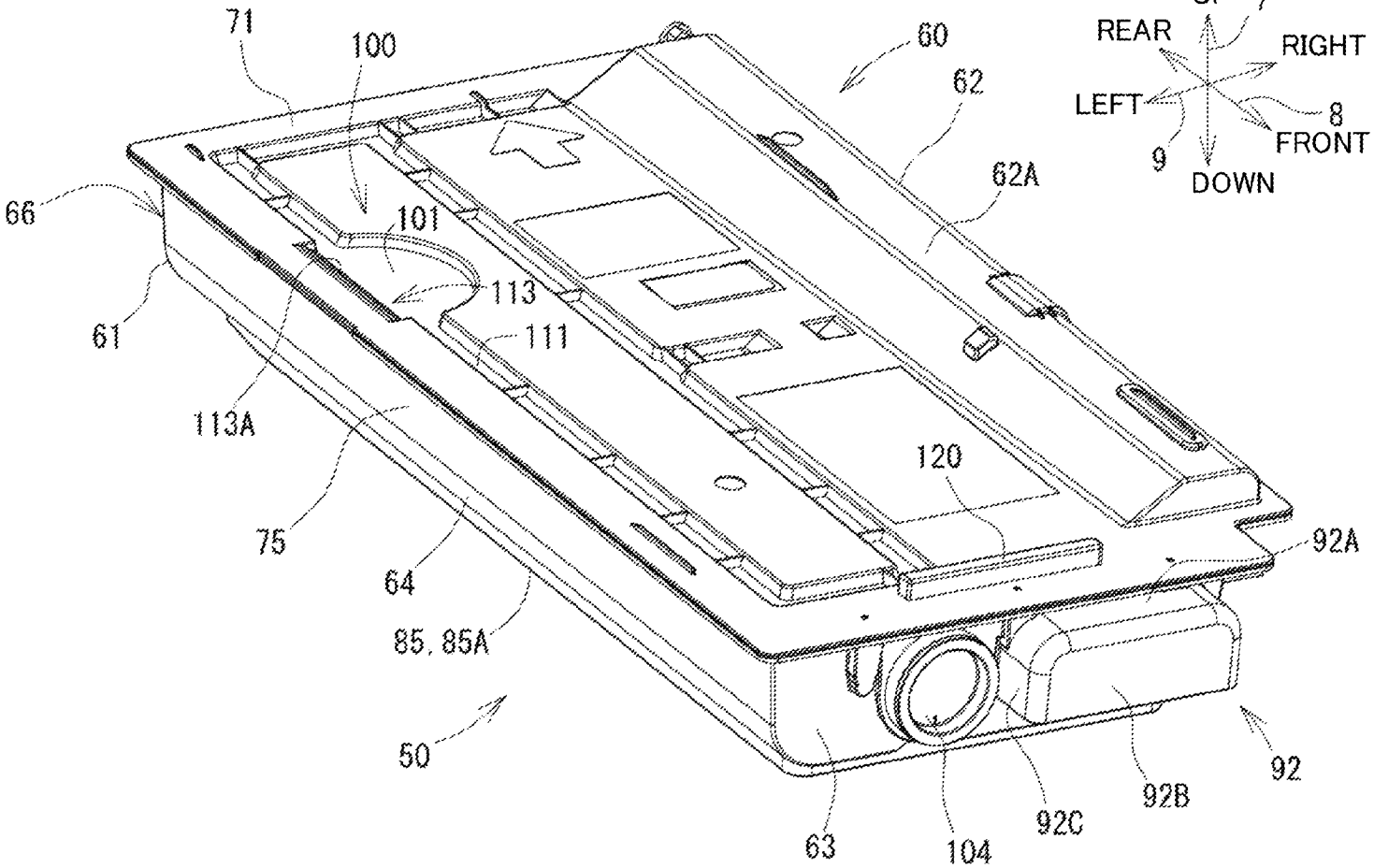
FIG. 2 is a perspective view of a front side of a toner container, as viewed from diagonally above the toner container, according to an embodiment of the present disclosure.

As shown in FIG. 2, the toner container 50 has a shape that is elongated in the front-rear direction 8. The toner container 50 includes: a container body 60 structured as a casing of the toner container 50; a drive transmission portion 106 (see FIG. 4); and a toner supply mechanism 123.

The container body 60 includes a lower housing 61 that is a lower casing, and a lid component 62 that is an upper casing. The lower housing 61 stores toner, and has a box-like shape that is elongated in the front-rear direction 8. Specifically, the lower housing 61 is defined in the front-rear direction 8 by a side surface 63 (a first side surface, see FIG. 2) on the front side, and a far side surface 66 (see FIG. 4) on the rear side. Further, the lower housing 61 is defined in the right-left direction 9 by a left side surface 75 (a second side surface, see FIG. 2) on the left side and a right side surface 74 (a third side surface, see FIG. 4) on the right side. Furthermore, the lower housing 61 has a bottom surface 64 having a curved shape, and the lower side of the lower housing 61 is defined by the bottom surface 64. The lower housing 61 has an opening 65 (see FIG. 8) that has a rectangular shape and is widely open on the top surface of the lower housing 61. Namely, the top surface of the lower housing 61 is open. The lid component 62 is mounted to the top surface of the lower housing 61 so as to cover the opening 65. Namely, the container body 60 is defined by the side surface 63, the far side surface 66, the left side surface 75, the right side surface 74, the bottom surface 64, and the lid component 62. In the container body 60 having such a structure, toner used for developing process by the developing device 33 is stored. The structure of the container body 60 is not limited to the structure in which the lid component 62 is mounted on the top surface. Any structure that has such a shape as to allow toner to be stored thereinside may be used.

The lower housing 61 is a synthetic resin product that is formed by molten synthetic resin being poured into a mold and being injection-molded (by injection molding). The lower housing 61 is formed such that all the portions have a uniform thickness. Namely, all the portions of the outer wall of the lower housing 61 have a uniform thickness. As a material of the lower housing 61, a thermoplastic synthetic resin may be used. Specifically, an ABS resin or a PET (polyethylene terephthalate) resin, or a synthetic resin including an ABS and/or PET resin as a main component is used as a material of the lower housing 61.

The lid component 62 is formed in such a shape as to correspond to the top surface of the lower housing 61, and has a rectangular shape that is elongated in the front-rear direction 8. The lid component 62 covers the opening 65 (see FIG. 8) of the lower housing 61, and has an outer edge portion 71 that contacts with the edge of the opening 65. The lid component 62 is a synthetic resin product formed by injection molding, similarly to the lower housing 61.

Figure 4:
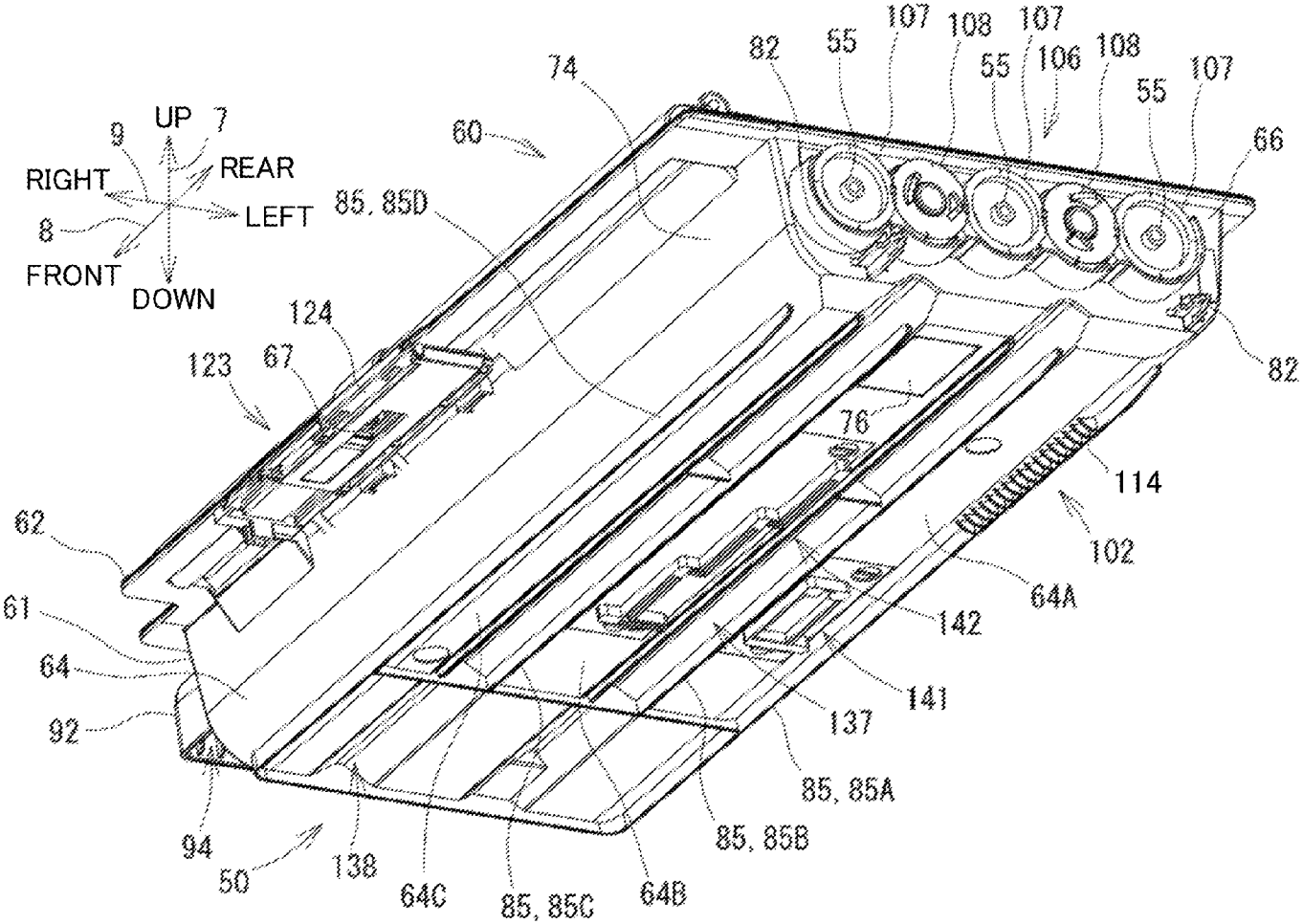
FIG. 4 is a perspective view of a rear side of the toner container shown in FIG. 2, as viewed from diagonally below the toner container.
Figure 5:
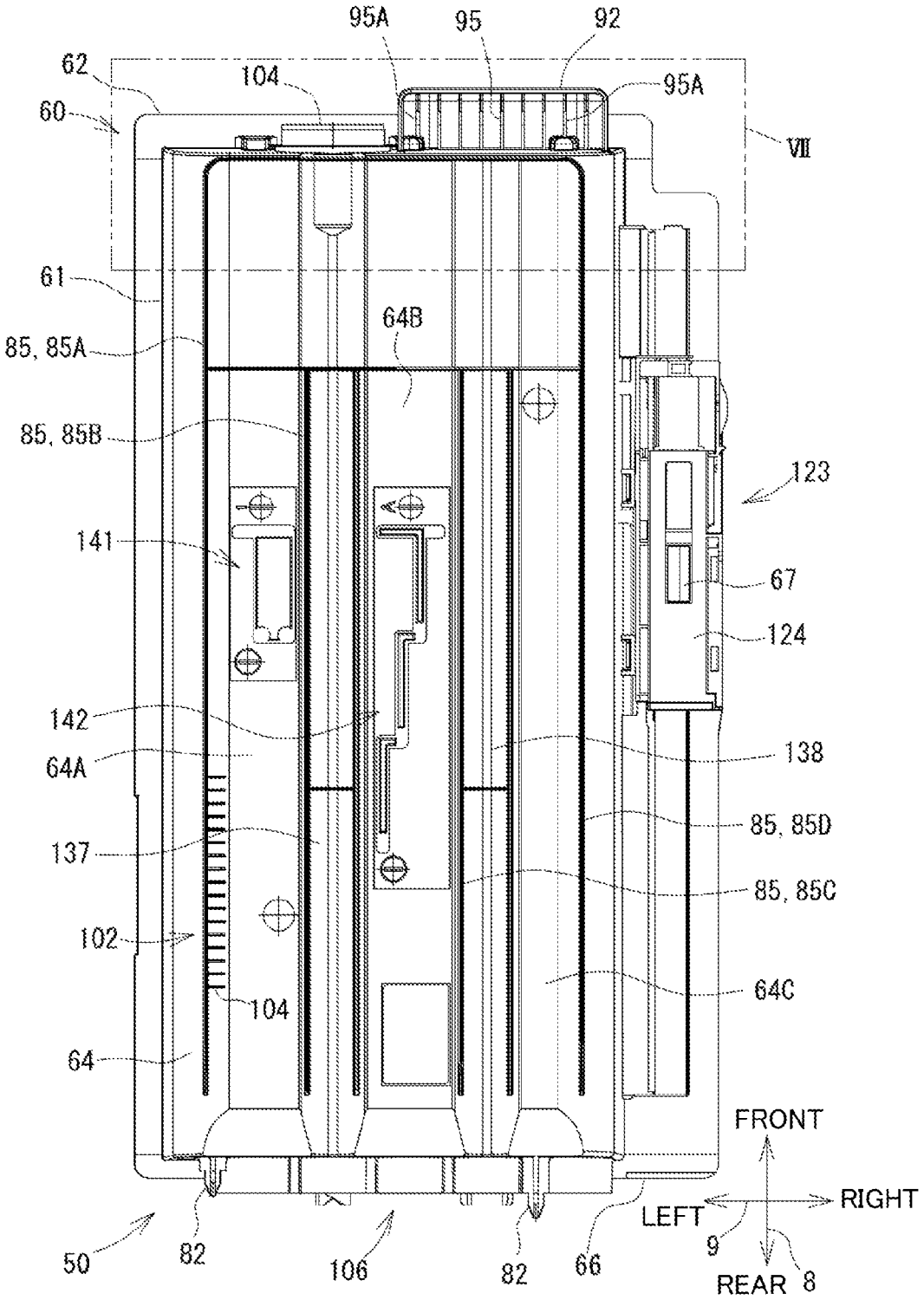
FIG. 5 is a bottom view of the toner container shown in FIG. 2.

As shown in FIG. 4 and FIG. 5, the lower housing 61 has a plurality of guide portions 85 (85A to 85D). The guide portions 85 are provided on the bottom surface 64 of the lower housing 61. The plurality of guide portions 85 guide the toner container 50 in a mounting direction (the direction corresponding to the front-rear direction 8) toward a mounting position defined in the casing 28 when the toner container 50 is inserted into the casing 28 of the image forming apparatus 10. In the present embodiment, the number of the guide portions 85 provided on the bottom surface 64 is four, and the four guide portions 85 are spaced from each other in the right-left direction 9. Each of the guide portions 85 projects in the direction perpendicular to the bottom surface 64, and has a rail-like shape that extends along the front-rear direction 8 and has a narrow width. When the toner container 50 is inserted into the casing 28, each of the plurality of guide portions 85 is inserted into a rail groove (not shown) in the container mounting portion of the casing 28. Thus, the toner container 50 is guided along the rail grooves in the mounting direction.

On the far side surface 66 of the lower housing 61, two pin-shaped positioning members 82 are provided. The positioning members 82 project rearward from the far side surface 66. When the toner container 50 is inserted into the casing 28 and reaches the mounting position, the positioning members 82 are inserted into positioning holes formed in the container mounting portion. Thus, the toner container 50 is assuredly mounted to the casing 28 at the mounting position.

As shown in FIG. 4, on the bottom surface 64 of the lower housing 61, a storage portion 76 using, for example, an RFID for transmitting internal information by a non-contacting manner, is provided. The storage portion 76 stores information associated with toner stored in the toner container 50. Examples of the information associated with toner include information indicating that the toner container 50 is unused, information representing an amount of toner contained in the toner container 50 which is unused, information indicating when the toner has been stored, and information representing conditions under which the stored toner can be used. The storage portion 76 is disposed in a region between the guide portion 85B and the guide portion 85C that are disposed on the inner side among the four guide portions 85 (85A to 85D). Specifically, the storage portion 76 is disposed in a rear end portion of the region. In the present embodiment, a non-contact type storage portion is illustrated as the storage portion 76. However, instead thereof, a storage portion that can transmit internal information in a contact manner using a contact terminal or the like, may be used.

As shown in FIG. 2, a handle 92 is provided on the side surface 63 (the first side surface) on the front side of the lower housing 61. The side surface 63 is one side surface, in the longitudinal direction, of the lower housing 61, and is a side surface that is located on the front side when the toner container 50 is mounted to the casing 28. The handle 92 is a portion that is held by fingers of a user when the toner container 50 is mounted to or dismounted from the casing 28, or when the toner container 50 is carried. In the present embodiment, the handle 92 is provided closer to the right side surface 74 (the third side surface, see FIG. 4) opposing the left side surface 75 (the second side surface) adjacent to the side surface 63, than to the left side surface 75. In other words, the handle 92 is provided to the right of the center position, in the right-left direction 9, of the side surface 63, that is, provided in the right end portion of the side surface 63.

Figure 6:
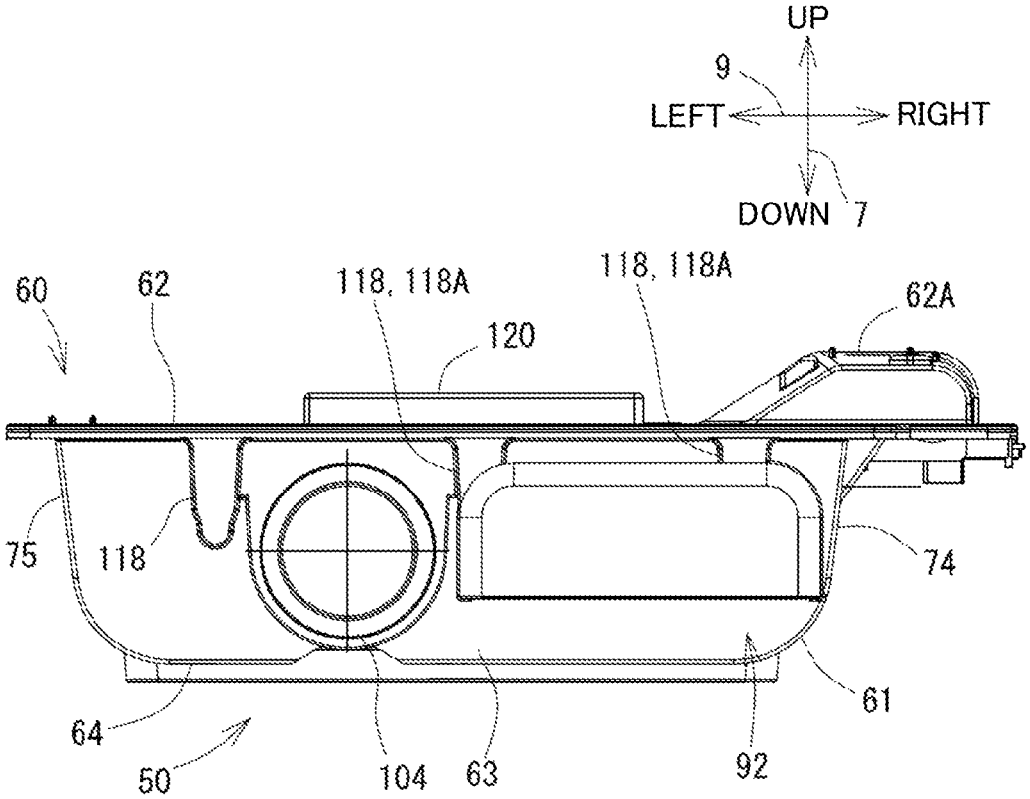
FIG. 6 is a front view of the toner container shown in FIG. 2.

Further, as shown in FIG. 2 and FIG. 6, a filling opening 104 through which toner is supplied into the lower housing 61 is formed on the side surface 63. The filling opening 104 is formed on the left side surface 75 side of the side surface 63. More specifically, the filling opening 104 is disposed to the left of the center position, in the right-left direction 9, of the side surface 63. On the other hand, the handle 92 is disposed to the right of and adjacent to the filling opening 104, and disposed in the right end portion of the side surface 63. More specifically, the handle 92 is disposed in a space to the right of the filling opening 104 on the side surface 63. In the present embodiment, the handle 92 is provided so as to have such a width as to cover a portion from the center portion to the right end portion, in the right-left direction 9, of the side surface 63.

The container body 60 includes a grip portion 100. The grip portion 100 includes a recess 101 and a slip preventer 102. The grip portion 100 is disposed closer to the left side surface 75 (the second side surface) adjacent to the side surface 63 in the container body 60 than to the right side surface 74.

The recess 101 is formed in the top surface of the container body 60, that is, in the top surface of the lid component 62. A groove 111 that is shallow, has a reduced width, and extends in the front-rear direction 8 is formed near the left end portion of the lid component 62. The recess 101 is a shallow recess that has a semicircular arc shape, and expands rightward from the groove 111. The bottom surface of the groove 111 and the bottom surface of the recess 101 are coplanar with each other, and the groove 111 and the recess 101 are provided, integrally with the lid component 62, so as to be connected to each other. The recess 101 is a portion in which a user's finger is placed when the toner container 50 is carried by the user. In particular, when a user holds the left end portion of the toner container 50, the user's thumb is placed in the recess 101. In the present embodiment, the area of the recess 101 is greater than at least the area of a pad of a person's thumb. Specifically, the recess 101 is formed in an arc shape having a radius of about 20 mm to about 30 mm. The depth of the recess 101 is about 5 mm to about 10 mm so as to allow a person to easily place her/his finger in the recess 101.

As shown in FIG. 2, a stepped rib portion 113 is provided in the end portion, on the left side surface 75 side, of the recess 101. The stepped rib portion 113 includes three ribs 113A that are stepped and extend in the front-rear direction 8. The stepped rib portion 113 acts as a slip preventer that prevents a user's finger from slipping leftward when the user's finger is placed. Further, the stepped rib portion 113 also acts as a reinforcing rib that reinforces the recess 101 having a strength that is reduced, as compared to the groove 111, due to the recess 101 being wider than the groove 111. The number of the ribs 113A in the stepped rib portion 113 is not limited to three. The number of the ribs 113A in the stepped rib portion 113 may be one, two, or greater than or equal to four when the ribs 113A can at least prevent slipping. Alternatively, instead of the ribs 113A, a plurality of projections may be provided at the end portion, on the left side surface 75 side, of the recess 111. Further, instead of the ribs 113A, a rubber member may be adhered.

The shape of the recess 101 is not limited to a semicircular arc shape. As the shape of the recess 101, various shapes such as a square shape and a rectangular shape, may be used.

As shown in FIG. 4 and FIG. 5, the slip preventer 102 is provided on the bottom surface 64 of the container body 60, that is, on the bottom surface 64 of the lower housing 61. The slip preventer 102 is provided on the left side surface 75 side of the bottom surface 64. Specifically, the slip preventer 102 includes a plurality of plate ribs 114 each of which has a plate-like shape and is disposed parallel to the side surface 63. In the present embodiment, the plurality of plate ribs 114 are mounted so as to be aligned in the direction (the direction corresponding to the front-rear direction 8) orthogonal to the side surface 63. Among corner portions formed between the guide portion 85A and the bottom surface 64, the plurality of plate ribs 114 are provided in the corner portion on the center portion side in the right-left direction 9 of the lower housing 61.

The slip preventer 102 is a portion on which user's fingers are placed when the toner container 50 is carried by the user. In particular, when a user holds the left end portion of the toner container 50, the user' fingers other than the user's thumb are placed on the slip preventer 102. In the present embodiment, the slip preventer 102 has such a length as to allow at least person's fingers other than her/his thumb to be placed. Specifically, the length, in the front-rear direction 8, of the slip preventer 102 is about 80 mm. The plurality of plate ribs 114 may be spaced from each other such that, for example, at least one plate rib among the plurality of plate ribs 114 contacts with pads of user's fingers when the user's fingers are placed on the slip preventer 102. The number of the plate ribs 114 is not limited to any specific number when the slipping can be prevented. Further, the slip preventer 102 may not be implemented as the plate ribs 114. Any member that can prevent slipping may be used. For example, a plurality of pip-like projections or a rubber member may be adhered.

In the toner container 50 of the present embodiment, the recess 101 and the slip preventer 102 of the grip portion 100 are positioned at almost the equivalent positions, respectively, in the front-rear direction 8 of the container body 60 in order to allow a user to easily hold the grip portion 100 with one hand. Namely, the slip preventer 102 is disposed below the recess 101. In other words, the recess 101 is disposed above the slip preventer 102. Specifically, the recess 101 and the slip preventer 102 are distant from the side surface 63 by a distance greater than a distance from the side surface 63 to the center position in the direction (the direction corresponding to the front-rear direction 8) orthogonal to the side surface 63, that is, the recess 101 and the slip preventer 102 are disposed rearward of the center position. The position of the grip portion 100 is not limited to the position described above, and may be, for example, the center position described above.

Since the handle 92 and the grip portion 100 are provided so as to satisfy such a positional relationship, a user is allowed to easily hold, with the user's right hand, the handle 92 disposed on the right side of the side surface 63, and consequently allowed to easily hold, with the user's left hand, the grip portion 100 disposed on the left side, when the toner container 50 is held by the user. In particular, since the recess 101 of the grip portion 100 is recessed relative to the lid component 62, a user is allowed to easily recognize the recess 101 as a portion to be held with the user's left hand. When the thumb of the user's left hand is placed on the recess 101 in order to hold a portion near the recess 101 with the user's left hand, the user's remaining fingers extend toward the bottom surface 64 and are naturally placed on the slip preventer 102. Thus, the user is allowed to easily hold the grip portion 100 of the toner container 50. Further, the user is allowed to assuredly hold the toner container 50 so as to prevent the toner container 50 from slipping and falling when holding the toner container 50. Further, since the toner container 50 can be easily held with both hands, operability for handling the toner container 50 is improved. For example, also when the toner container 50 that is filled with toner is mounted to or dismounted from the casing 28, the handle 92 is held with a user's right hand, and the grip portion 100 is held with the user's left hand, thereby stably handling the toner container 50 so as to prevent the toner container 50 from slipping and falling from the user's hands.

As shown in FIG. 4, the toner supply mechanism 123 is provided in the container body 60. The toner supply mechanism 123 has a supply opening 67 through which toner stored in the container body 60 is supplied to the developing device 33. The toner supply mechanism 123 and the supply opening 67 are provided in the end portion, on the right side surface 74 side, of the container body 60. The toner supply mechanism 123 includes a shutter 124 that opens and closes the supply opening 67. The toner supply mechanism 123 slides the shutter 124 so as to open the supply opening 67 when the toner container 50 is mounted to the mounting position of the casing 28. On the other hand, the toner supply mechanism 123 slides the shutter 124 so as to close the supply opening 67 when the toner container 50 is drawn from the mounting position. As shown in FIG. 4, in the container body 61, the supply opening 67 is disposed on the right side surface 74 side, and the handle 92 is also disposed closer to the right side surface 74 than to the left side surface 75. Therefore, since a user holds the handle 92 with the user's right hand, and holds, with the user's left hand, the grip portion 100 disposed in the left end portion of the toner container 50 when the toner container 50 is held, the user's hands are prevented from becoming dirty with toner attached to a portion near the supply opening 67.

As shown in FIG. 4 and FIG. 5, a space 94 is formed between the handle 92 and the side surface 63 so as to be open at the lower portion. Into the space 94, user's fingers are inserted. When the user inserts, into the space 94, the user's fingers other than the user's thumb, the user is allowed to hold the handle 92 with the user's fingers being caught in the space 94. At this time, the user's thumb is placed on a projection 120 (see FIG. 2 and FIG. 3) described below.

As shown in FIG. 2, the handle 92 has a perpendicular portion 92A, a bent portion 92B, and side wall portions 92C. The perpendicular portion 92A has its base end portion connected to the side surface 63, and has a plate-like shape that is perpendicular to the side surface 63. The bent portion 92B is connected to the front end portion of the perpendicular portion 92A, and has a plate-like shape that is bent downward from the front end portion of the perpendicular portion 92A so as to approach the bottom surface 64 of the lower housing 61. The side wall portions 92C are provided at end portions (both end portions in the right-left direction 9), on both lateral sides, of each of the perpendicular portion 92A and the bent portion 92B. End portions, on the side surface 63 side, of the side wall portions 92C are connected to the side surface 63. Thus, the space 94 is formed between the handle 92 and the side surface 63 so as to be open at the lower portion. When the handle 92 has the space 94, the handle 92 may have, for example, a structure in which the perpendicular portion 92A and the bent portion 92B are provided without providing the side wall portions 92C, or a structure in which the bent portion 92B and the side wall portions 92C are provided without providing the perpendicular portion 92A.

Figure 3:
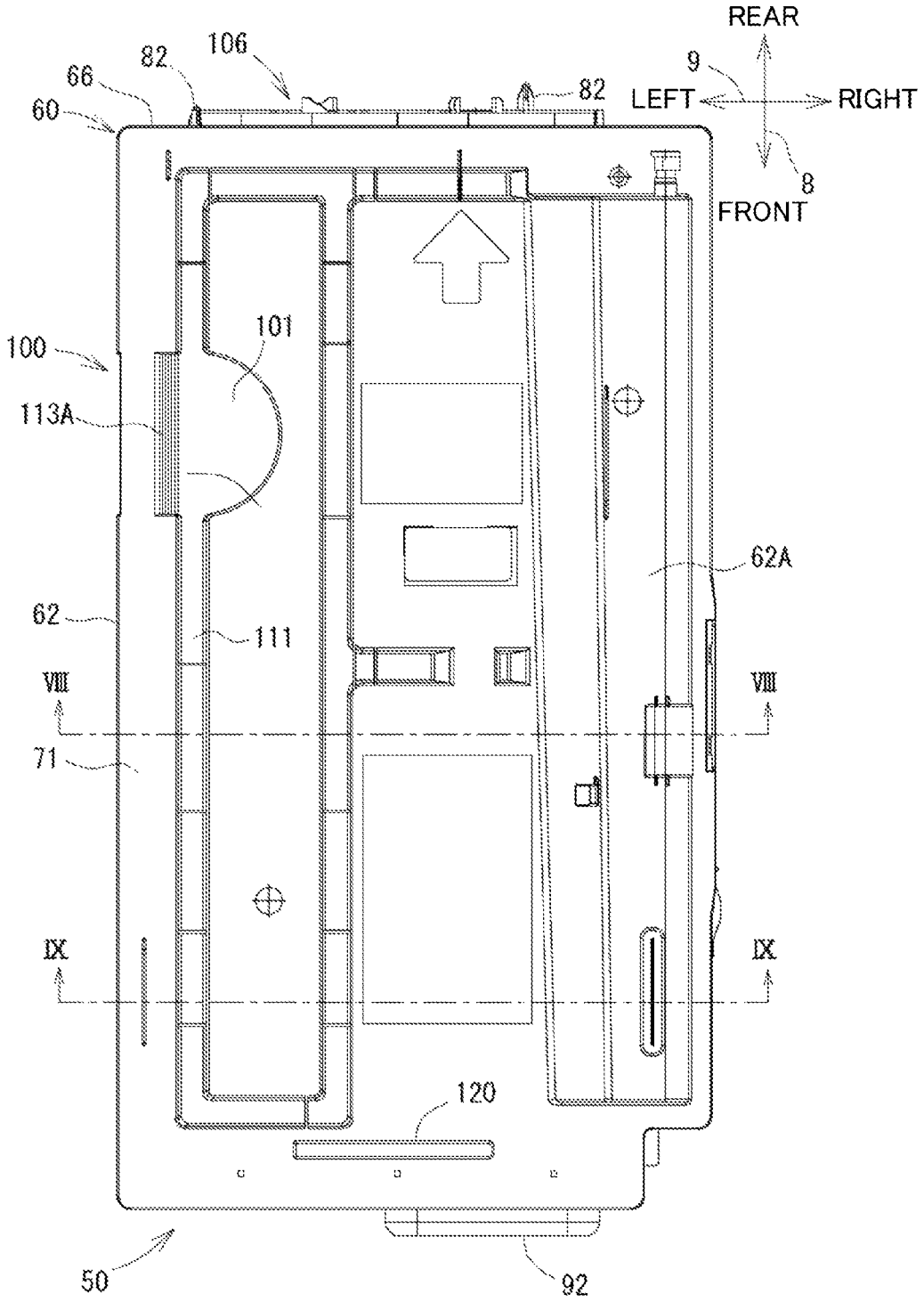
FIG. 3 is a top view of the toner container shown in FIG. 2.

As shown in FIG. 2 and FIG. 3, on the top surface of the container body 60, that is, on the top surface of the lid component 62, the projection 120 is provided. More specifically, the projection 120 is provided at the end portion, on the side surface 63 side, of the top surface of the lid component 62. When a user places the user's fingers other than the user's thumb on the handle 92 of the toner container 50, the user's thumb is placed on the projection 120. As shown in FIG. 2, the projection 120 is shaped so as to project upward from the top surface of the lid component 62. Further, the projection 120 is formed so as to be elongated in the direction (the first direction) along the side surface 63, that is, in the right-left direction 9, on the top surface of the lid component 62. Specifically, the length, in the front-rear direction 8, of the projection 120 is about 5 mm, and the length, in the right-left direction 9, of the projection 120 ranges from about 70 mm to about 80 mm. In the present embodiment, the projection 120 is disposed at the center, in the right-left direction 9, of the front end portion of the lid component 62.

Since the handle 92 and the projection 120 are thus provided, a user is allowed to hold the toner container 50 by placing the user's four fingers so as to be caught in the handle 92, and then placing the user's thumb so as to be caught on the projection 120. Thus, the toner container 50 can be horizontally held by the user in a stable manner. In particular, since the handle 92 is disposed in the right side portion of the side surface 63 in the toner container 50, if the toner container 50 is held by a user with the use of the handle 92 only, the left side portion of the toner container 50 is inclined downward, and it is difficult to horizontally hold the toner container 50. However, since the projection 120 is disposed so as to be shifted leftward relative to the handle 92, and the projection 120 is held by the user so as to be pulled forward by the user's thumb, a force for raising the left side portion of the toner container 50 is applied. Thus, the user is allowed to horizontally hold the toner container 50 in a stable manner.

Figure 7:
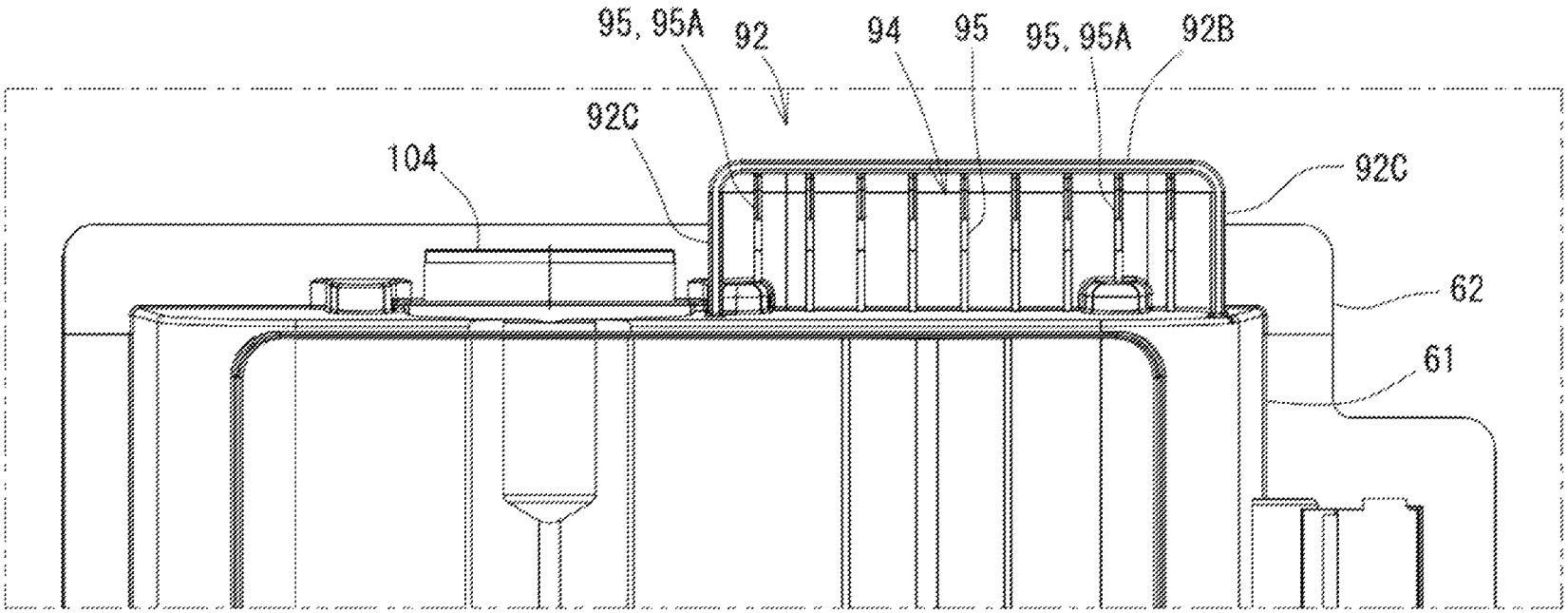
FIG. 7 is an enlarged view of a main portion VII shown in FIG. 5.

As shown in FIG. 7, the handle 92 includes a plurality of reinforcing ribs 95. The reinforcing ribs 95 are provided on the reverse face of the handle 92. Specifically, the reinforcing ribs 95 extend from the side surface 63 through the reverse face of the perpendicular portion 92A to the reverse face of the bent portion 92B. The reinforcing ribs 95 are equally spaced from each other, in the right-left direction 9, on the reverse face of the handle 92. Since the reinforcing ribs 95 having such a structure are provided, the strength of the handle 92 or the strength of the side surface 63 is enhanced. Further, pads of fingers that are caught by the handle 92 contact with the reinforcing ribs 95. Therefore, the reinforcing ribs 95 make it difficult to slide the fingers in the right-left direction 9, thereby improving operability for handling the toner container 50. Thus, a user is allowed to easily hold the handle 92.

Further, as shown in FIG. 6 and FIG. 7, the side surface 63 includes three shaft receiving portions 118 that are spaced from each other in the right-left direction 9. The shaft receiving portions 118 support the front end portions of rotation shafts 55 (see FIG. 8) of three rotating members 56 disposed inside the container body 60 such that the front end portions are rotatable. As shown in FIG. 7, the shaft receiving portions 118 are shaped so as to project outward (in the front direction) from the side surface 63. The shaft receiving portions 118 are formed by being extruded forward from the inner surface of the side surface 63 in injection molding using a mold. Therefore, each shaft receiving portion 118 has thereinside a cylindrical hole that extends in the front-rear direction 8. The front end portion of each rotation shaft 55 is inserted into the hole, and supported. In the present embodiment, two shaft receiving portions 118A, among the three shaft receiving portions 118, which are provided between the filling opening 104 and the right side surface 74, are covered with the handle 92. In other words, the handle 92 is positioned so as to cover the two shaft receiving portions 118A disposed to the right of the filling opening 104. Since the handle 92 is provided at such a position, the shaft receiving portions 118A that project from the side surface 63 can be prevented from being damaged due to external contact, without deteriorating operability for the handle 92.

In the present embodiment, as shown in FIG. 7, a portion of the reinforcing ribs 95A in the plurality of reinforcing ribs 95 is formed on the outer surfaces of the two shaft receiving portions 118A. Namely, the reinforcing ribs 95A extend from the shaft receiving portions 118A through the reverse face of the perpendicular portion 92A to the reverse face of the bent portion 92B. Therefore, each of the shaft receiving portions 118A has an enhanced strength due to the reinforcing ribs 95A.

Figure 8:
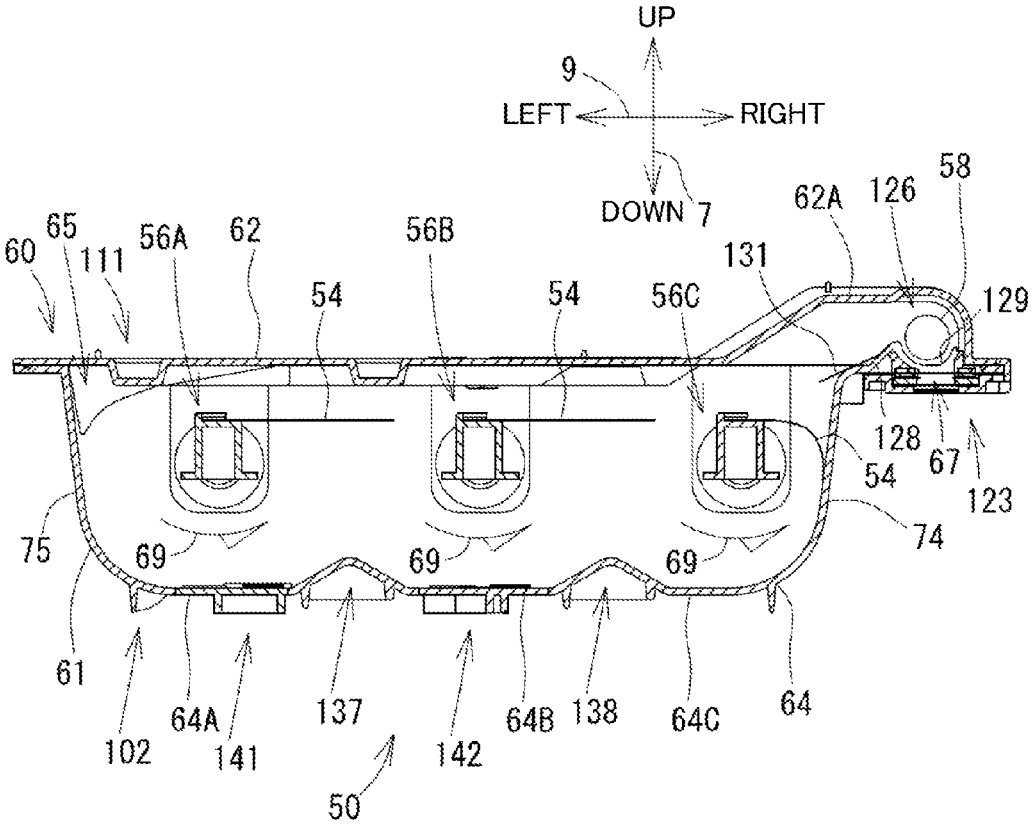
FIG. 8 is a cross-sectional view illustrating a cross-section taken along a section line VIII-VIII in FIG. 3.

As shown in FIG. 8, in the container body 60, the three rotating members 56 (56A to 56C) are provided. Each of the rotating members 56 has a shape that is elongated in the front-rear direction 8, and is disposed inside the container body 60 along the front-rear direction 8. The three rotating members 56 are disposed in the container body 60 so as to be spaced from each other by a predetermined distance in the right-left direction 9. In the present embodiment, the bottom surface 64 of the container body 60 is divided, in the right-left direction 9, into three regions 64A, 64B, and 64C so as to correspond to positions at which the three rotating members 56, respectively, are disposed. Specifically, the region 64A and the region 64B are divided from each other by a groove 137 that is formed between the regions 64A and 64B and that extends in the front-rear direction 8. Further, the region 64B and the region 64C are divided from each other by a groove 138 that is formed between the regions 64B and 64C and that extends in the front-rear direction 8. In the present embodiment, the groove 137 is formed at a position corresponding to a mid-position between the rotating member 56A and the rotating member 56B. Further, the groove 138 is formed at a position corresponding to a mid-position between the rotating member 56B and the rotating member 56C.

As shown in FIG. 4, the bottom surface 64 has a first non-exchangeable-shape portion 141 and a second non-exchangeable-shape portion 142. Specifically, the first non-exchangeable-shape portion 141 and the second non-exchangeable-shape portion 142 are provided on the bottom surface 64 of the container body 60 so as to be spaced from each other in the direction (the direction corresponding to the right-left direction 9) orthogonal to the mounting direction in which the toner container 50 is mounted to the casing 28. The first non-exchangeable-shape portion 141 and the second non-exchangeable-shape portion 142 are used to determine whether or not the toner container 50 conforms to the image forming apparatus 10. For example, in a case where the first non-exchangeable-shape portion 141 and the second non-exchangeable-shape portion 142 are each provided on the bottom surface so as to have a predetermined pattern shape, when the toner container 50 is mounted to the casing 28 without hindering of fitting of the first non-exchangeable-shape portion 141 and the second non-exchangeable-shape portion 142, it can be determined that the toner container 50 conforms to the image forming apparatus 10. On the other hand, in a case where the first non-exchangeable-shape portion 141 and the second non-exchangeable-shape portion 142 prevent the toner container 50 from being mounted to the casing 28, it can be determined that the toner container 50 does not conform to the image forming apparatus 10. Each of the first non-exchangeable-shape portion 141 and the second non-exchangeable-shape portion 142 has such a pattern shape as to enable determination as to whether or not the toner container 50 conforms to the image forming apparatus 10, and the pattern shape is different for each kind (type) of the toner container 50.

For the first non-exchangeable-shape portion 141 and the second non-exchangeable-shape portion 142, plural pattern shapes are prepared so as to correspond to various types. The pattern shape varies depending on, for example, the types of the image forming apparatus 10, colors of toner, and regions and countries to which the image forming apparatuses are shipped. In the present embodiment, the first non-exchangeable-shape portion 141 and the second non-exchangeable-shape portion 142 having different pattern shapes, respectively, are formed on the bottom surface 64. The first non-exchangeable-shape portion 141 and the second non-exchangeable-shape portion 142 are provided, on the bottom surface 64, in the regions 64A and 64B, respectively, which are spaced from each other in the right-left direction 9 across the groove 137. More specifically, the first non-exchangeable-shape portion 141 is provided in the region 64A of the bottom surface 64. On the other hand, the second non-exchangeable-shape portion 142 is provided in the region 64B of the bottom surface 64. Although the bottom surface 64 is divided into three regions, that is, the regions 64A, 64B, and 64C, the non-exchangeable-shape portion is not provided in each of the regions. The non-exchangeable-shape portions are provided in the regions 64A and 64B except the region 64C close to the supply opening 67. Namely, in the region 64C closest to the supply opening 67, the non-exchangeable-shape portion is not provided.

Further, as shown in FIG. 5, the first non-exchangeable-shape portion 141 is provided near the center portion, in the front-rear direction 8, of the region 64A. The second non-exchangeable-shape portion 142 is provided near the center portion, in the front-rear direction 8, of the region 64B. More specifically, the first non-exchangeable-shape portion 141 and the second non-exchangeable-shape portion 142 are provided closer to the handle 92 side (the front side) than the slip preventer 102 is.

Thus, the first non-exchangeable-shape portion 141 and the second non-exchangeable-shape portion 142 are provided on the bottom surface 64 in the regions 64A and 64B, respectively, different from each other. Therefore, when the pattern shapes of the first non-exchangeable-shape portion 141 and the second non-exchangeable-shape portion 142 are used in combination, the number of the pattern shapes can be increased, by using simple shapes and structures, as compared to the number of pattern shapes which can be obtained by a single non-exchangeable-shape portion.

As shown in FIG. 8, in addition to the three rotating members 56 (56A to 56C), a conveying member 58 that conveys toner to the supply opening 67 is provided in the container body 60. The rotating members 56 are rotatably provided in the container body 60, and toner stored in the container body 60 is agitated while being scooped, by the rotating members 56 being rotated. Further, the conveying member 58 is rotatably provided in the container body 60, and toner is conveyed to the supply opening 67 by the conveying member 58 being rotated.

Each of the rotating members 56 includes: the rotation shaft 55 that is elongated in the front-rear direction 8; and an agitating member 54 mounted to the rotation shaft 55. The rotation shaft 55 is provided in the container body 60 so as to be rotatable together with the agitating member 54. The rotation shaft 55 is a shaft member having a shape that is elongated in one direction, and both ends, in the longitudinal direction, of the rotation shaft 55 are rotatably supported by the far side surface 66 and the side surface 63 of the lower housing 61. Specifically, end portions, on the front side, of the rotation shafts 55 of the three rotating members 56A, 56B, and 56C are rotatably supported by the three shaft receiving portions 118, respectively, provided on the side surface 63. On the other hand, end portions, on the rear side, of the rotation shafts 55 are inserted into shaft holes (not shown), respectively, which penetrate through the far side wall 66, and thus the end portions on the rear side are rotatably supported.

As shown in FIG. 4, the drive transmission portion 106 is provided outside the far side surface 66 of the container body 60. The drive transmission portion 106 transmits a rotational force for a predetermined rotation direction to each of the rotation shafts 55, to transmit a rotation driving force to each of the rotating members 56. Specifically, the drive transmission portion 106 includes, for example, driving gears 107 connected to the rear end portions of the rotation shafts 55, and idle gears 108 provided between the adjacent driving gears 107. When a driving force of a motor (not shown) is transmitted to one of the driving gears 107, a rotation driving force is transmitted through the drive transmission portion 106 to all the rotating members 56. Thus, the rotating members 56 are rotated in the counterclockwise direction (the direction indicated by an arrow 69 in FIG. 8) shown in FIG. 8. The drive transmission portion 106 is connected to the end portion, on the rear side, of a rotation shaft of the conveying member 58 by means of a not-illustrated gear, or the like, and a driving force of the motor is also transmitted to the conveying member 58 by the drive transmission portion 106.

The agitating member 54 is formed by an elastic material such as a PET (polyethylene terephthalate) resin, so as to have a film-like shape having a reduced thickness. Needless to say, the material of the agitating member 54 is not limited to a PET resin, and the agitating member 54 may be formed by a synthetic resin such as vinyl chloride or polycarbonate. In the present embodiment, the agitating member 54 is mounted to the entire portion, in the longitudinal direction, of each rotation shaft 55.

As shown in FIG. 8, in a state where each rotating member 56 is disposed in the container body 60, the end portion of each agitating member 54 closely contacts with the inner surface (the reverse face of the lid component 62 or the inner surface of the lower housing 61) of the container body 60. This is because the agitating member 54 has a length that is longer than a distance from the rotation shaft 55 to the inner surface of the container body 60. Therefore, when the rotating members 56 are disposed in the container body 60, the end portion of each agitating member 54 contacts with the reverse face of the bottom surface 64 or the lid component 62, the right side surface 74, the left side surface 75, or the like, and is thus bent, and the side surface of the end portion of each agitating member 54 closely contacts with the inner surface of the container body 60.

Figure 9:
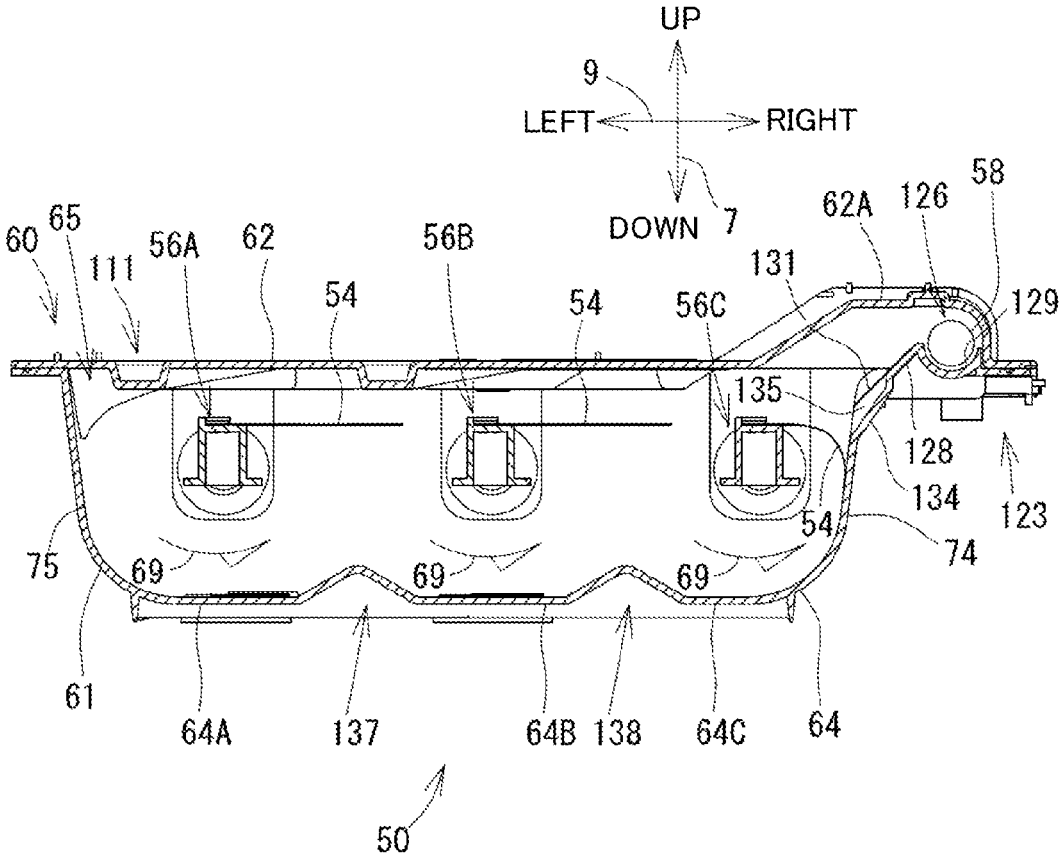
FIG. 9 is a cross-sectional view illustrating a cross-section taken along a section line IX-IX in FIG. 3.

A toner conveying path 126 in which toner is conveyed to the supply opening 67 is provided in the container body 60. As shown in FIG. 8 and FIG. 9, the toner conveying path 126 is provided in the upper right end portion of the container body 60, and extends in the front-rear direction 8. As shown in FIG. 8, the lower housing 61 has an inclined wall 128 that extends diagonally right-upward from the upper end portion of the right side surface 74. The inclined wall 128 extends upward from the edge of the opening 65. Further, the lower housing 61 has a curved wall 129 that is arc-shaped so as to be curved downward from the extension end of the inclined wall 128. On the other hand, a right end portion 62A of the lid component 62 is formed so as to have a shape that is bent upward from the inclined wall 128 and the curved wall 129, such that a space can be formed between the right end portion 62A, and the inclined wall 128 and the curved wall 129. In the present embodiment, the toner conveying path 126 is formed by the right end portion 62A of the lid component 62, and the curved wall 129. Namely, the toner conveying path 126 is a space surrounded by the right end portion 62A of the lid component 62, and the curved wall 129.

The toner conveying path 126 has the supply opening 67 through which toner in the container body 60 is supplied to the outside. The supply opening 67 is formed in the curved wall 129 that forms the bottom surface of the toner conveying path 126.

The conveying member 58 is rotatably provided in the toner conveying path 126. The conveying member 58 is, for example, a screw shaft that has helical blades provided on the shaft member. By the conveying member 58 being rotated, toner in the toner conveying path 126 is conveyed to the supply opening 67 by the conveying member 58. Needless to say, the conveying member 58 may have any structure in which toner in the toner conveying path 126 can be conveyed to the supply opening 67.

When the rotating members 56 are rotated in the container body 60 in the direction indicated by the arrow 69, toner stored in the container body 60 is agitated by the agitating members 54. Further, when the rotating member 56C disposed closest to the supply opening 67 in the container body 60 is rotated, not only toner is agitated, but also toner is scooped upward along the inner surface of the right side surface 74 by the agitating member 54. The toner scooped by the rotating member 56C is conveyed from the inner surface of the right side surface 74 through the inclined surface of the inclined wall 128 to the toner conveying path 126. Toner conveyed to the toner conveying path 126 is conveyed to the supply opening 67 by the conveying member 58, and supplied through the supply opening 67 into the developing device 33. When the developing device 33 has no space into which toner is to be supplied through the supply opening 67, toner is not supplied through the supply opening 67 into the developing device 33. In this case, toner conveyed to the supply opening 67 overflows the toner conveying path 126, and is returned into the container body 60 so as to slide on the inclined surface of the inclined wall 128.

In the toner container 50 of the present embodiment, toner is likely to be accumulated on the inclined surface of the inclined wall 128. Therefore, as shown in FIG. 8 and FIG. 9, a film member 131 is provided in the container body 60 in order to prevent toner from being accumulated on the inclined surface or return the accumulated toner into the container body 60. The film member 131 is mounted to the inclined wall 128 (the inner wall) that extends from the toner conveying path 126 to the bottom surface 64 of the container body 60. The film member 131 is formed, by an elastic material such as a PET (polyethylene terephthalate) resin, so as to have a film-like shape having a reduced thickness. Needless to say, the film member 131 may be formed by a resin other than a PET resin, and the film member 131 may be formed by, for example, a synthetic resin such as vinyl chloride or polycarbonate.

Figure 10:
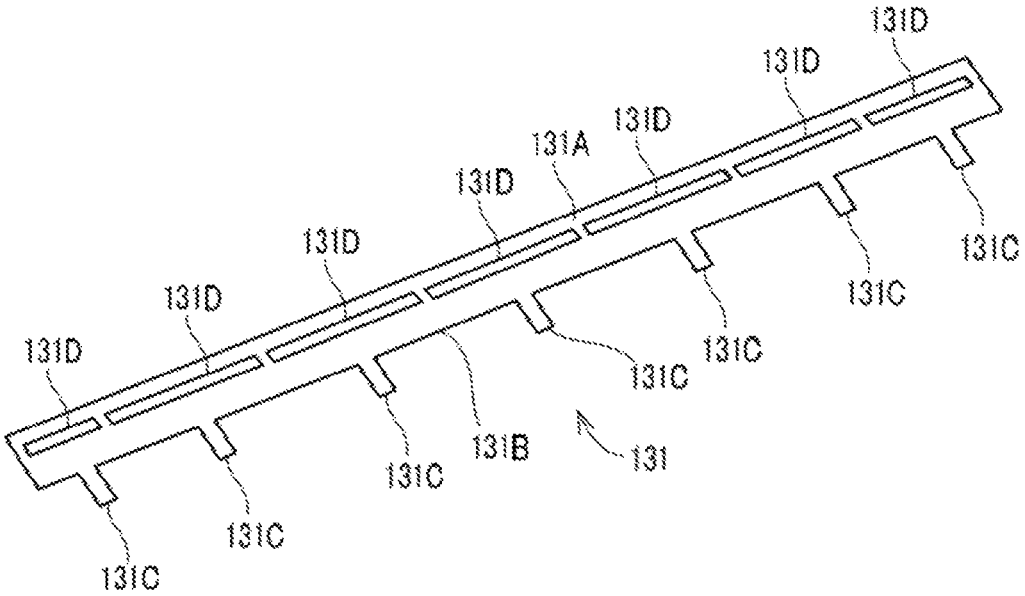
FIG. 10 is a perspective view of a film member provided in the toner container shown in FIG. 2.

As shown in FIG. 10, the film member 131 has a shape that is elongated in one direction. The length, in the longitudinal direction, of the film member 131 is equal to the length, in the front-rear direction 8, of the inclined wall 128. The film member 131 is fixed to the inclined wall 128 such that the longitudinal direction of the film member 131 corresponds to the front-rear direction 8. Specifically, a mounted portion 131A of the film member 131 is fixed to the upper end of the inclined wall 128, that is, to the end portion, on the toner conveying path 126 side, of the inclined wall 128, by, for example, an adhesive or a double-sided tape. Thus, the film member 131 is provided in the entirety of a region, in the front-rear direction 8, of the inclined wall 128. The mounted portion 131A corresponds to an end portion, on one side in the transverse direction, of the film member 131, and the mounted portion 131A is fixed to the inclined wall 128. Therefore, an end portion 131B, on the other side in the transverse direction, of the film member 131 is a free end.

As shown in FIG. 10, a plurality of slits 131D are formed in a region closer to the mounted portion 131A than to the end portion 131B. Each of the slits 131D is elongated in the longitudinal direction. The slits 131D are openings through which toner can pass. Further, a plurality of projections 131C are provided in the end portion 131B. The projections 131C are spaced from each other by a predetermined distance along the longitudinal direction of the film member 131. The projections 131C project from the inclined wall 128 toward the inner side of the container body 60. Specifically, the projections 131C project toward a region in which the agitating member 54 of the rotating member 56C rotates. In other words, the projections 131C project so as to be able to contact with the agitating member 54 of the rotating member 56C. Therefore, the projections 131C contact with the agitating member 54 when the rotating member 56C is rotated in the direction indicated by the arrow 69. Thus, the film member 131 oscillates in the direction perpendicular to the inclined wall 128. Specifically, when the agitating member 54 of the rotating member 56C rotates to contact with the projections 131C, the projections 131C are moved upward by the agitating member 54. When the agitating member 54 is moved away from the projections 131C to come into a non-contact state, the film member 131 is returned to an initial position due to its elasticity. At this time, the film member 131 oscillates about the mounted portion 131A. When the oscillation is transmitted to the inclined wall 128, the oscillation is also transmitted to toner accumulated on the inclined wall 128. Thus, toner is shaken from the inclined wall 128 into the container body 60 due to the oscillation, and is returned into the container body 60.

In the present embodiment, as shown in FIG. 9, a stepped portion 134 is provided in the inclined wall 128. The stepped portion 134 is provided on one end portion, in the front-rear direction 8 (the direction corresponding to the axial direction of the rotating member 56), of the inclined wall 128. Specifically, the stepped portion 134 is provided on the end portion, on the front side, of the inclined wall 128. The stepped portion 134 forms a space 135 having a predetermined height, between the stepped portion 134 and the reverse face of the film member 131. An inclination angle of the front end portion of the inclined wall 128 is set so as to be greater than inclination angles of regions, of the inclined wall 128, other than the front end portion, thereby forming the stepped portion 134. Namely, the inclination angle of the inclined surface of the stepped portion 134 is greater than the inclination angles of the inclined surfaces in the regions, of the inclined wall 128, other than the stepped portion 134. Thus, since the space 135 is formed by the stepped portion 134, oscillation of the film member 131 is increased in the stepped portion 134. Therefore, when the film member 131 contacts with the agitating member 54 and oscillates, oscillation of the film member 131 is increased in the stepped portion 134 as compared to other regions. Therefore, oscillation of the film member 131 in the stepped portion 134 is transferred to toner accumulated near the stepped portion 134, and toner near the stepped portion 134 is thus shaken due to the oscillation, thereby enabling toner to be assuredly returned into the container body 60.

Further, in the present embodiment, since the stepped portion 134 is provided in the front end portion of the inclined wall 128, oscillation of the film member 131 is increased at the front end. Therefore, the increased oscillation of the film member 131 at the front end facilitates transmission of oscillation from the front end of the film member 131 toward the rear portion thereof. Due to such transmission of oscillation toward the rear portion, toner accumulated on the inclined wall 128 is returned into the container body 60 with an enhanced efficiency.

Further, since the stepped portion 134 is provided, an increased amount of toner can be scooped into the space 135 by the agitating member 54 of the rotating member 56C. Toner that has entered the space 135 is supplied into the toner conveying path 126 through the slits 131D formed in the film member 131. Namely, the space 135 enables an increased amount of toner to be efficiently supplied into the toner conveying path 126.

In the present embodiment, the drive transmission portion 106 is provided on the rear side of the container body 60. Therefore, even when the stepped portion 134 is not provided on the rear side of the inclined wall 128, toner on the rear side of the inclined wall 128 is assuredly returned into the container body 60 due to oscillation generated when the drive transmission portion 106 is driven. Therefore, as in the present embodiment, when the drive transmission portion 106 is provided on one side, in the front-rear direction 8, of the container body 60, the stepped portion 134 is provided on the side opposite to the side on which the drive transmission portion 106 is provided. Thus, toner on the inclined wall 128 can be returned into the container body 60 without complicating the structure of the inclined wall 128. Needless to say, the stepped portion 134 may be provided in each of the front end portion and the rear end portion of the inclined wall 128.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A toner container comprising:

a container body that includes a lower housing that can store toner thereinside, the container body having a shape that is elongated;

a toner conveying path that is provided in an upper portion of the lower housing at an end thereof in a direction orthogonal to a longitudinal direction of the container body, the toner conveying path extending in the longitudinal direction to have an elongated shape and having, on a bottom surface thereof, a supply opening through which toner is supplied to the outside;

a rotating member that is rotatably provided in the lower housing, that extends in the longitudinal direction to have an elongated shape, and that rotates to scoop, into the toner conveying path, toner stored in the lower housing;

a conveying member that is rotatably provided in the toner conveying path, and that rotates to convey, along the longitudinal direction toward the supply opening, toner in the toner conveying path;

an inclined wall that is provided at a portion between the toner conveying path and an upper end portion of a side wall of the lower housing at the end thereof and that extends diagonally downward from the toner conveying path to the upper end portion;

a film member whose one end is fixed to an end portion of the inclined wall on the toner conveying path side such that the film member extends along the inclined wall and projects diagonally downward toward a region in which the rotating member rotates; and a stepped portion that is provided in a lower end of the inclined wall, and that forms, between the stepped portion and the film member, a space having a predetermined height.

2. The toner container according to claim 1, wherein the stepped portion is provided in at least one end portion, in the longitudinal direction of the inclined wall.

3. The toner container according to claim 2, further comprising a drive transmission portion that is provided in one end portion, in the longitudinal direction, of the container body, and that transmits a rotation driving force to the rotating member, wherein the stepped portion is provided in an end portion, of the inclined wall, on a side opposite to a side on which the drive transmission portion is provided.

4. The toner container according to claim 3, wherein an inclination angle of an inclined surface of the stepped portion is greater than an inclination angle of an inclined surface of a region, of the inclined wall, other than the stepped portion.

5. The toner container according to claim 4, wherein the film member is provided in an entire region, in the longitudinal direction, of the inclined wall.

6. The toner container according to claim 3, wherein the film member is provided in an entire region, in the longitudinal direction, of the inclined wall.

7. The toner container according to claim 2, wherein an inclination angle of an inclined surface of the stepped portion is greater than an inclination angle of an inclined surface of a region, of the inclined wall, other than the stepped portion.

8. The toner container according to claim 7, wherein the film member is provided in an entire region, in the longitudinal direction, of the inclined wall.

9. The toner container according to claim 2, wherein the film member is provided in an entire region, in the longitudinal direction, of the inclined wall.

10. The toner container according to claim 1, wherein an inclination angle of an inclined surface of the stepped portion is greater than an inclination angle of an inclined surface of a region, of the inclined wall, other than the stepped portion.

11. The toner container according to claim 1, wherein the lower housing has a curved wall that is arc-shaped so as to be curved downward from an upper end of the inclined wall, the curved wall forming the bottom surface of the toner conveying path.

12. The toner container according to claim 11, wherein the container body includes a lid component that covers an upper surface of the lower housing, and the toner conveying path is a portion surrounded by the curved wall and an end portion of the lid component on a side of the end of the lower housing.

13. An image forming apparatus comprising:

a toner container; and an image forming portion that forms an image on a recording medium by using toner supplied from the toner container, wherein the toner container includes:

a container body that includes a lower housing that can store toner thereinside, the container body having a shape that is elongated;

a toner conveying path that is provided in an upper portion of the lower housing at an end thereof in a direction orthogonal to a longitudinal direction of the container body, the toner conveying path extending in the longitudinal direction to have an elongated shape and having, on a bottom surface thereof, a supply opening through which toner is supplied to the outside;

a rotating member that is rotatably provided in the lower housing, that extends in the longitudinal direction to have an elongated shape, and that rotates to scoop, into the toner conveying path that is positioned above the rotating member, toner stored in the lower housing;

a conveying member that is rotatably provided in the toner conveying path, and that rotates to convey, along the longitudinal direction toward the supply opening, toner in the toner conveying path;

an inclined wall that is provided at a portion between the toner conveying path and an upper end portion of a side wall of the lower housing at the end thereof and that extends diagonally downward from the toner conveying path to the upper end portion;

a film member whose one end is fixed to an end portion of the inclined wall on the toner conveying path side such that the film member extends along the inclined wall and projects diagonally downward toward a region in which the rotating member rotates; and a stepped portion that is provided in a lower end of the inclined wall, and that forms, between the stepped portion and the film member, a space having a predetermined height.

14. The image forming apparatus according to claim 13, wherein the stepped portion is provided in at least one end portion, in the longitudinal direction, of the inclined wall.

15. The image forming apparatus according to claim 14, further comprising a drive transmission portion that is provided in one end portion, in the longitudinal direction, of the container body, and that transmits a rotation driving force to the rotating member, wherein the stepped portion is provided in an end portion, of the inclined wall, on a side opposite to a side on which the drive transmission portion is provided.

* * * * *